United States Patent [19]

Lasswell et al.

[11] 4,031,277

[45] June 21, 1977

[54] METHOD OF COATING METAL WITH VINYLIDENE CHLORIDE-VINYL CHLORIDE COPOLYMER

[76] Inventors: Tull C. Lasswell, 230 Pawnee Path, Lake Orion, Mich. 48035; John L. Monier, 1968 Harwood Drive, Oxford, Mich. 48051

[22] Filed: Aug. 12, 1974

[21] Appl. No.: 496,375

Related U.S. Application Data

[60] Continuation-in-part of Ser. No. 195,508, Nov. 3, 1971, abandoned, which is a division of Ser. No. 851,261, Aug. 19, 1969, Pat. No. 3,635,369.

[52] U.S. Cl. ..... 427/388 R; 427/372 R; 427/385 R; 428/463

[51] Int. Cl.[2] ..... B05D 3/02

[58] Field of Search ..... 117/161 UF, 161 UH, 117/161 UZ, 132 C; 260/91.7, 86.3, 32.8 R; 427/388, 372, 385, 388; 428/463

[56] References Cited

UNITED STATES PATENTS

| | | | |
|---|---|---|---|
| 2,233,442 | 3/1941 | Wiley | 28/1 |
| 2,237,315 | 4/1941 | Reilly | 91/70 |
| 2,249,917 | 7/1941 | Reinhardt | 260/32 |
| 2,376,706 | 5/1945 | L um | 75/22 |
| 2,675,334 | 4/1954 | Gray et al. | 117/132 |
| 2,859,135 | 11/1958 | Rossin | 117/139.5 |
| 2,946,702 | 7/1960 | Bach | 117/132 C X |
| 3,073,718 | 1/1963 | Lund | 117/132 C X |
| 3,251,817 | 5/1966 | Hahn et al. | 260/87.7 |
| 3,310,519 | 3/1967 | Hahn et al. | 117/161 UF X |
| 3,424,706 | 1/1969 | Smith et al. | 260/29.6 |
| 3,459,591 | 8/1969 | Konishi et al. | 117/161 UH X |
| 3,476,287 | 11/1969 | Kinnauy | 220/42 |
| 3,489,601 | 1/1970 | Stapp et al. | 117/138.8 |
| 3,637,426 | 1/1972 | Gallano et al. | 117/161 UF X |

FOREIGN PATENTS OR APPLICATIONS

| | | | |
|---|---|---|---|
| 1,034,364 | 6/1966 | United Kingdom | 117/161 UF |

OTHER PUBLICATIONS

Vinylidene Chloride Resins, *Modern Plastics Encyclopedia*, 1948, pp. 161–163.

Vinyl and Related Polymers, Schildkecht, 1956, pp. 448–453.

Vinyl Resins, *Reinhold Plastics Applications Series*, Smith, (1962), pp. 78–81.

*Primary Examiner*—Ronald H. Smith
*Assistant Examiner*—Shrive P. Beck
*Attorney, Agent, or Firm*—Hauke & Patalidis

[57] ABSTRACT

A method for precoating a plug adapted to close off core openings in an internal combustion engine with a plastic which forms a fluid tight seal between the peripheral surface of the plug and the core opening upon insertion of the plug therein. The plug is preferably coated with a solution of vinylidene chloride-vinyl chloride copolymer in cyclohexanone which is cured by heating for twenty minutes at 160° F (71° C). The thickness of the plastic coating may be doubled by heating the coated plug for ten minutes at 250° F (121° C).

11 Claims, 4 Drawing Figures

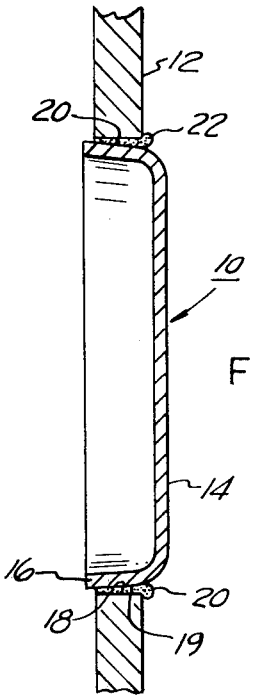
FIG. 1
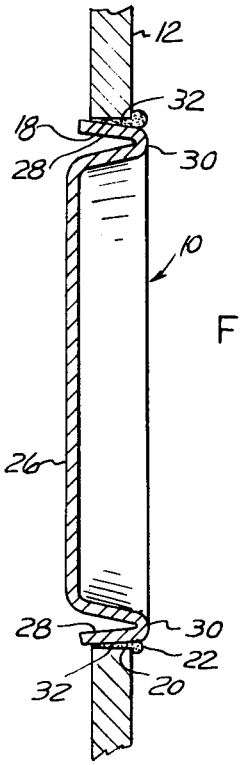
FIG. 2
FIG. 3
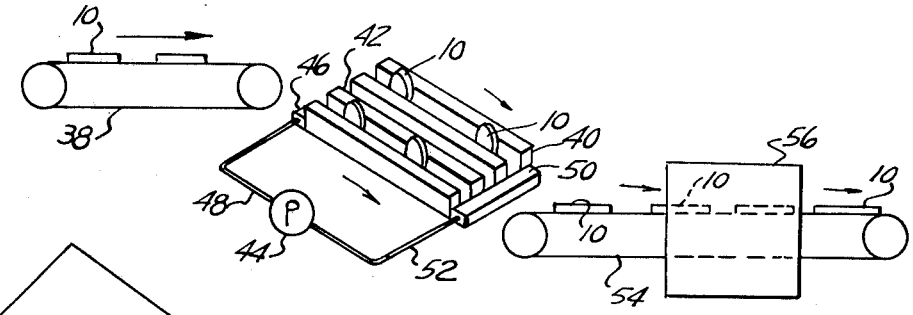
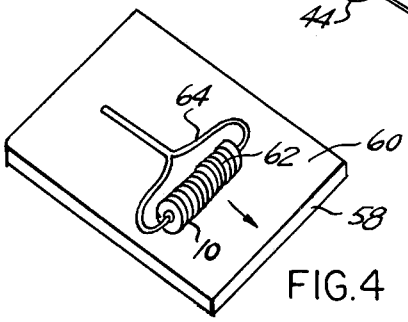
FIG. 4

METHOD OF COATING METAL WITH VINYLIDENE CHLORIDE-VINYL CHLORIDE COPOLYMER

CROSS REFERENCE TO RELATED PATENTS AND APPLICATIONS

This application is a continuation-in-part of application Ser. No. 195,508, filed Nov. 3, 1971, now abandoned which is a division of application Ser. No. 851,261, filed Aug. 19, 1969, now U.S. Pat. No. 3,635,369, issued Jan. 18, 1972 and reissued Feb. 18, 1975, under No. Re. 28,342.

BACKGROUND OF THE INVENTION

1. Field of the Invention

This invention relates generally to plug members adapted to provide a seal closure in an apertured workpiece and more particularly to a precoated plug for sealing an opening for the core holes in water jackets of internal combustion engines and other similar manufacturing holes, and to a method for applying a plastic coat to the peripheral surface of such plug members.

2. Description of the Prior Art

The cylinder block of an internal combustion engine is usually provided with a water jacket which in many cases is cast integral with the cylinder. This jacket generally has a plurality of holes passing therethrough to the outside which have been provided for removing the sand cores after the block has been cast. They are ordinarily provided with a sealing plug secured therein by friction so as to provide an enclosed cavity.

It may also be necessary to drill access holes or passages in a casting in order to permit internal machining or to provide for cross connecting internal fluid carrying passages and the like. It is usually necessary to close off these access holes or passages in order to preclude introduction of foreign matter internally of the part and to prevent fluid leakage therefrom. One of the current methods of closing off such access holes in passages has been the forcing of a short metal rod into the end of the passage. Although this method is satisfactory in certain applications, it is quite unsatisfactory under circumstances where fluid under pressure is subsequently introduced into the passage inasmuch as the rod may be forced out of the hole or the passage by the pressurized fluid.

A variety of methods have been employed to provide a satisfactory sealing plug which is reliable and inexpensive. Such prior methods have included the use of a plug having a diameter larger than the opening it is to close, at least to the extent that there will be a relatively large compressive engagement between the plug and the opening. In order to insert the rod into the opening without cracking the workpiece it is sometimes necessary to heat the area of the workpiece about the opening or to cool the rod to cryogenic temperature prior to insertion. This type of sealing means results in a relatively expensive operation and is difficult to use on high volume production. Other methods have consisted in tapping the access hole and threading a bolt or threaded plug therein. Such methods are relatively time consuming and therefore expensive from a production standpoint, and it is also possible that fluid pressure behind the plug may result in leakage past the threads to the outside of the casting.

Specifically in the automotive industry, core openings are generally sealed by means of plugs which are press fitted within the openings. Prior to the press fitting of the plugs within the openings, the openings are coated with an adhesive material by an operator. Although such a method is satisfactory, it does require two steps, that is, the manual coating of the opening and the insertion of the plug generally by means of an automatic plug inserting machine. Since the coating is applied manually this sometimes leads to an improper coating of the part by the operator, and thus a proper seal between the plug and the opening is not achieved. Furthermore, existing adhesive coatings utilized in the automotive industry tend to become brittle and chip off in a relatively short period, thus losing the desired seal. Such existing adhesive coatings are subjected to oil, oil additives, water, anti-freeze and high temperature, all of which lead to a short sealing life.

It would therefore be very desirable to provide a plug for sealing an access hole in a metallic casting and the like in which the plug has been precoated with a plastic-like material so as to provide and insure a fluid tight seal upon insertion of the plug within the opening.

SUMMARY OF THE INVENTION

The present invention which will be described in greater detail hereinafter comprises a metallic plug adapted to be inserted within an aperture or opening formed within a metallic casting and the like. The peripheral surface of the metallic plug which engages the walls of the opening is precoated with a plastic material prior to insertion. The plastic coating is of such thickness that when the metallic plug is press fitted into the aperture of the metallic workpiece, the plastic coating fills any cracks within the wall of the aperture while at the same time interference between the plug and the walls of the opening tends to peel back a portion of the plastic coating such that the coating acts as a gasket between the two parts, thus forming a fluid tight seal to prevent introduction of foreign matter internally of the part and to preclude the passage of fluid leakage therefrom.

The plugs are precoated by applying a solution of a vinylidene chloride-vinyl chloride copolymer powder in a solvent, preferably cyclohexanone, to the engaging surface of the plug. The plug is then heated at a predetermined temperature for a predetermined period of time. For example, to obtain a one mil (25 microns) thickness on the peripheral surface of the plug, a mixture of one part by weight of the aforementioned powder to two parts of the solvent is applied to the plug surface and heated for twenty minutes at 160° F (71° C). However, if the same composition by weight of powder to solvent is heated at 250° F (121° C) for 10 minutes the thickness of the resultant plastic coating will be double that of the plastic coating obtained when heated at 160° F (71° C) for twenty minutes. Plugs coated in the manner described herein are resistant to oil, oil additives, water, anti-freeze and are capable of withstanding substantially higher temperature than the hereinbefore mentioned prior art devices, thus a long sealing life is insured.

It is therefore an object of this invention to provide a simple, efficient and inexpensive precoated plug having a long life, for use in closing an apertured workpiece.

It is also an object of this invention to provide a method for precoating such a plug.

DESCRIPTION OF THE DRAWING

The several objects, advantages and applications of the present application will become apparent to those skilled in the art when the accompanying description of some examples of the best modes contemplated for practicing the invention is read in conjunction with the accompanying drawing wherein like reference numerals refer to like parts and in which:

FIG. 1 is a fragmentary sectional view of a water jacket wall of an internal combustion engine illustrating an example of a sealing plug constructed in accordance with the present invention;

FIG. 2 is a similar fragmentary sectional view of a water jacket wall showing another example of a sealing plug constructed in accordance with the present invention;

FIG. 3 is a diagrammatic illustration of an example of one method employed in practicing the present invention; and FIG. 4 is a diagrammatic illustration of another example of a method employed in practicing the present invention.

DESCRIPTION OF THE PREFERRED EMBODIMENTS

Referring to FIG. 1 there is shown one example of a precoated plug 10 inserted in the water jacket wall 12 of an internal combustion engine. The plug 10 is cup-shaped having a bottom portion 14 and a cylindrical side flange portion 16. The plug 10 is adapted to be mounted in a circular opening 18 formed in the water jacket wall 12. The side flange portion 16 is so designed as to be slightly tapered outwardly from the bottom portion 14, this taper of the flange being illustrated in an exaggerated form in FIG. 1. The outside or the peripheral surface 19 of the side flange 16 is precoated with a plastic material 20 which will be described in greater detail hereinafter. The outside diameter of the side flange 16 is so sized relative to the inner diameter of the opening 18, and the thickness of the plastic coating 20 is such as to permit the precoated plug 10 to be inserted forcefully within the opening 18 such that a portion of the plastic coating 20 is peeled back and acts as a gasket as is illustrated at 22. The combination of the press fit of the side flange 16 against the inner diameter of the opening 18 and the plastic coating 20 results in providing a fluid tight seal between the outer periphery of the side flange 16 and the opening 18 so as to prevent introduction of foreign matter internally of the water jacket and to preclude fluid leakage therefrom. The plug 10 is preferably of a metallic material such as steel and has a predetermined amount of resiliency in the tapered side flange 16 such that when it is inserted within the hole 18 the side flange 16 tends to exert an outward force against the opening 18, to further maintain the fluid tight seal. As viewed in FIG. 1 the precoated plug is inserted leftwardly into the opening 18 such that the bottom portion 14 is external of the water jacket.

Referring to FIG. 2 for a description of another example of a precoated plug constructed in accordance with the present invention there is shown a plug member 10 including a cup shaped portion 26 having its side flange 28 reversely bent at 30 to provide an outer peripheral wall 32 which extends outwardly and tapers slightly outwardly from the bend 30, as illustrated in FIG. 2 in an exaggerated form. The tapered outer peripheral wall 32 is precoated with the plastic coating 20 which will be described in greater detail hereinafter.

The plug member 10 of FIG. 2 is adapted for use in the same manner as hereinbefore described with respect to the plug 10 of FIG. 1, namely it is adapted for mounting in the circular opening 18 formed in the water jacket 12. The outer diameter of the outer peripheral wall 32 and the thickness of the plastic coating 20 are so dimensioned that when the plug 10 is forcefully press fitted into the opening 18, a portion of the plastic material is peeled back to form a gasket which is illustrated at 22, thus creating a fluid tight seal between the wall 12 of the opening 18 and the peripheral wall 32 of the plug 10. In a similar manner as the plug 10 of FIG. 1, the plug member 10 of FIG. 2 is made of a metallic material, such as steel, and has a slight resiliency in the peripheral wall 32 thereof which causes it to exert an outward force against the surface of the opening 18, thus to further insure a fluid tight seal between the wall 12 and the plug 10. As viewed in FIG. 2, the precoated plug is inserted leftwardly into the opening 18 such that the bottom portion 26 is internal of the water jacket.

The plastic coating 20 applied to the peripheral surface of the plug member 10 is initially in a liquid form. Referring to FIG. 3, for a schematic illustration of one example of the application of the plastic material 20 to the plugs, there is shown a conveyor belt 38 which carries the uncoated plugs 10 to an inclined trough 40. The uncoated plugs are transferred from the conveyor belt to the trough 40 by any suitable means (not shown) such as manually or by gravity.

The trough 40 is comprised of a plurality of narrow channels 42 which are adapted to guide the plugs 10 as they roll along their outer surfaces. The trough is partially filled with the plastic liquid material and as the plugs roll down the inclined trough 40 under the influence of gravity their peripheral surface is coated with the liquid plastic material. The liquid plastic material is recirculated in the trough passageways 42 by means of a pump, illustrated schematically at 44. The pump 44 supplies the liquid plastic material to a liquid distributing element 46 via a conduit 48. The liquid flows through the trough passageways 42 wherein the peripheral surfaces of the plugs are coated. The liquid is received by a liquid collecting element 50 and returned to the pump 44 via a conduit 52 for reuse within the trough 40.

The plugs leave the trough 40 and are transferred by any suitable means (not shown) such as manually or by gravity, to a conveyor belt 54 which in turn carries the coated plugs 10 to a heated drying area indicated schematically at 56 wherein the coated plugs are heated at a predetermined temperature for a predetermined period as described in the several examples hereinafter. The conveyor belt 54 carries the plugs past the heated drying area 56 where they are unloaded and packaged in the customary manner.

Referring to FIG. 4, for a schematic illustration of another example of the application of the plastic material 20 to the plug, there is shown a coating pad 58, the surface 60 of which consists of a fabric impregnated with liquid plastic material 20. The surface 60 may be initially impregnated with the liquid plastic material 20 by any suitable means (not shown) such as by painting, rolling or spraying the plastic material thereon. After subsequent use of the pad 58, the surface 60 is replenished in the same manner.

The plugs are stacked together on top of each other as illustrated in FIG. 4 to form a cylindrically shaped roller unit 62 which is maintained as a unit by means of a clamping device 64. The clamping device 64 is attached to the opposite ends of the roller unit 62 in such a manner as to provide a sufficient clamping force against the stacked plugs to prevent their separation, while permitting the roller unit 62 to rotate about its longitudinal axis. The roller unit 62 is moved back and forth across the impregnated surface 60 by means of the clamping device 64 until the tapered peripheral surfaces of the plugs have been sufficiently coated.

The clamping device 64 may be manually moved across the surface 60 or actuated by suitable machinery (not shown).

After the plugs have been suitably coated with the liquid plastic material 20, they are placed on the conveyor 54 of FIG. 3 and dried in the heated area 56 in the same manner as hereinbefore described.

The plastic material is comprised preferably of a vinylidene choride-vinyl chloride copolymer powder and solvent cyclohexanone. However, other solvents such as methol-ethyl-ketone and the like may be used with the polyvinylidene chloride powder.

EXAMPLE I

A plug similar to the types described hereinbefore was coated with a solution of one part by weight of polyvinylidene chloride powder (vinylidene choloride-vinyl chloride copolymer, designated QX-2168 and obtained from the Saran Product Development Plant of Dow Chemical Co., Midland, Michigan) and two parts by weight of cyclohexanone. The coated plug was heated at 160° F (71° C) for twenty minutes and resulted in a one mil (25 microns) thickness of the plastic coating on the outer peripheral surface of the plug.

EXAMPLE II

A plug was coated with a solution composed of one part by weight of the vinylidene chloride-vinyl chloride copolymer powder and one and one-half parts by weight of cyclohexanone solvent. The coated plug was heated at 160° F (71° C) for 20 minutes and resulted in a plastic coated plug having a plastic coating of a thickness of 1 and ½ mils (38 microns) on the peripheral edge surface of the plug.

EXAMPLE III

A plug was rolled through a solution of one part by weight of the vinylidene chloride-vinyl chloride copolymer powder and one part by weight of a cyclohexanone solvent. The coated plug was heated at 160° F (71° C) for 20 minutes, and resulted in a plastic coating of 2 mil (50 microns) thickness on the peripheral edge surface of the plug.

EXAMPLE IV

Each of the prior EXAMPLES I, II, and III was repeated except the coated plug was heated at 250° F (170° C) for 10 minutes. In each case the thickness of the resultant plastic coating on the plug was doubled, that is, when the plugs were heated at 250° F (170° C) for 10 minutes in EXAMPLE I a two mil (50 microns) thickness resulted, in EXAMPLE II a three mil (75 microns) thickness resulted and in EXAMPLE III a four mil (100 microns) thickness resulted.

EXAMPLE V

A group of plugs coated as described in each of the EXAMPLES I-IV were heated in an oven at 300° F (149° C) for 3 minutes without any deterioration. A temperature of 300° F (149° C) is substantially higher than the actual temperatures which such plugs are subjected to in automotive applications.

The resultant plastic which is precoated on the plugs is one that will adhere thereto, is non-sticky and pliable. A range from 1 to 6 mils (25 to 150 microns), with three mils (75 microns) being typical, is representative of a sufficient thickness for the plugs so as to achieve the desired amount of sealing in the particular applications in which such plugs may be employed such as hereinbefore described.

Having thus described the invention, what is claimed is as follows:

1. The method of providing a surface of a metallic part with a dry pliable coating, said method consisting of applying at room temperature to said surface of said metallic part a liquid solution consisting of vinylidene chloridevinyl chloride copolymer powder and a solvent for forming on said surface a wet coating of said solution, and of subsequently heating said metallic part at a temperature in the range of 160° F (71° C) to 250° F (121° C) for a time period of 20 to 10 minutes, wherein the solvent is selected from the group consisting of methyl-ethyl-ketone and cyclohexanone, the ratio by weight of the vinylidene chloride-vinyl chloride copolymer to the solvent is between one to one and one to two and the thickness of the resulting dry coating on the surface of said metallic part is comprised between 1 mil (25 microns) and 6 mils (150 microns) and is directly proportional to the concentration of vinylidene chloride-vinyl chloride copolymer in said solution and to the heating temperature and inversely proportional to the heating time duration.

2. The method of claim 1, wherein the coated material is heated at 160° F (71° C).

3. The method of claim 2, wherein the coated material is heated for 20 minutes.

4. The method of claim 3, wherein the ratio by weight of the vinylidene chloride-vinyl chloride copolymer powder to the solvent is 1 to 2.

5. The method of claim 3, wherein the ratio by weight of the vinylidene chloride-vinyl chloride copolymer powder to solvent is 1 to 1½.

6. The method of claim 3, in which the ratio by weight of the vinylidene chloride-vinyl chloride copolymer to the solvent is 1 to 1.

7. The method of claim 1, wherein the coated material is heated at 250° F (121° C).

8. The method of claim 7, wherein the coated material is heated for 10 minutes.

9. The method of claim 8, wherein the ratio by weight of the vinylidene chloride-vinyl chloride copolymer powder to the solvent is 1 to 2.

10. The method of claim 8, wherein the ratio by weight of the vinylidene chloride-vinyl chloride copolymer powder to the solvent is 1 to 1½.

11. The method of claim 8, wherein the ratio by weight of vinylidene chloride-vinyl chloride copolymer powder to the solvent is 1 to 1.

* * * * *